US006690324B2

(12) United States Patent
Vail et al.

(10) Patent No.: US 6,690,324 B2
(45) Date of Patent: Feb. 10, 2004

(54) PHASED ARRAY ANTENNA HAVING REDUCED BEAM SETTLING TIMES AND RELATED METHODS

(75) Inventors: David Kenyon Vail, West Melbourne, FL (US); Frank J. Tabor, Melbourne, FL (US); Daniel P. Blom, Palm Bay, FL (US); Stephen S. Wilson, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/991,495

(22) Filed: Nov. 9, 2001

(65) Prior Publication Data

US 2002/0070897 A1 Jun. 13, 2002

Related U.S. Application Data

(60) Provisional application No. 60/255,007, filed on Dec. 12, 2000.

(51) Int. Cl.[7] ..... H01Q 3/22
(52) U.S. Cl. ..... 342/372; 342/377
(58) Field of Search ..... 342/368, 371, 342/372, 377

(56) References Cited

U.S. PATENT DOCUMENTS

| | | | | | |
|---|---|---|---|---|---|
| 3,646,558 | A | * | 2/1972 | Campanella | 342/373 |
| 3,999,182 | A | * | 12/1976 | Moeller et al. | 342/372 |
| 4,931,803 | A | | 6/1990 | Shimko | 342/371 |
| 4,980,691 | A | | 12/1990 | Rigg et al. | 342/372 |
| 4,994,814 | A | | 2/1991 | Aoki et al. | 342/372 |
| 4,996,532 | A | | 2/1991 | Kirimoto et al. | 342/81 |
| 5,008,680 | A | | 4/1991 | Willey et al. | 342/372 |
| 5,027,126 | A | | 6/1991 | Basehgi et al. | 342/372 |
| 5,038,148 | A | * | 8/1991 | Aoki et al. | 342/372 |
| 5,072,228 | A | | 12/1991 | Kuwahara | 342/360 |
| 5,130,717 | A | * | 7/1992 | Ewen et al. | 342/375 |
| 5,225,841 | A | | 7/1993 | Krikorian et al. | 342/204 |
| 5,231,405 | A | | 7/1993 | Riza | 342/375 |
| 5,243,274 | A | | 9/1993 | Kelsey et al. | 324/158 R |
| 5,283,587 | A | | 2/1994 | Hirshfield et al. | 342/372 |
| 5,353,031 | A | | 10/1994 | Rathi | 342/372 |
| 5,493,255 | A | | 2/1996 | Murtojarvi | 330/296 |
| 5,559,519 | A | | 9/1996 | Fenner | 342/174 |
| 5,592,179 | A | | 1/1997 | Windyka | 342/372 |
| 5,655,841 | A | | 8/1997 | Storm | 374/183 |
| 5,680,141 | A | | 10/1997 | Didomenico et al. | 342/372 |

(List continued on next page.)

OTHER PUBLICATIONS

Sanzgiri, Shashi et al, "A Hybrid Tile Approach for Ka Band Subarray Modules" IEEE Trans. on Antennas and Propagation, vol 43, No. 9, Sept. 1995, pp. 953–959.*

*Primary Examiner*—Gregory C. Issing
(74) *Attorney, Agent, or Firm*—Allen, Dyer, Doppelt, Milbrath & Gilchrist, P.A.

(57) ABSTRACT

A phased array antenna may include a substrate and a plurality of phased array antenna elements carried by the substrate. The phased array antenna may also include a plurality of antenna element controllers for the phased array antenna elements and a central controller for providing beam steering commands and edge trigger synchronization signals for the antenna element controllers. Furthermore, each of the antenna element controllers may store a respective next beam steering command and implement the respective next beam steering command as a respective active beam steering command responsive to the edge trigger synchronization signal from the central controller. The edge trigger synchronization signal may be delivered substantially simultaneously to all of the antenna element controllers, and each antenna element controller may detect the edge trigger synchronization pulse only during a predetermined time window, for example.

21 Claims, 3 Drawing Sheets

U.S. PATENT DOCUMENTS

| | | | | |
|---|---|---|---|---|
| 5,771,016 | A | 6/1998 | Mullins et al. | 342/372 |
| 5,821,901 | A | * 10/1998 | Zagrodnick et al. | 342/368 |
| 5,938,779 | A | 8/1999 | Preston | 714/718 |
| 5,990,830 | A | 11/1999 | Vail et al. | 342/368 |
| 5,995,740 | A | 11/1999 | Johnson | 395/500.41 |
| 5,999,990 | A | 12/1999 | Sharrit et al. | 718/8 |
| 6,011,512 | A | 1/2000 | Cohen | 342/372 |
| 6,023,742 | A | 2/2000 | Ebeling et al. | 710/107 |
| 6,157,681 | A | 12/2000 | Daniel et al. | 375/298 |
| 6,163,220 | A | 12/2000 | Schellenberg | 330/295 |
| 6,172,642 | B1 | 1/2001 | DiDomenico et al. | 342/368 |

* cited by examiner

PHASED ARRAY ANTENNA HAVING REDUCED BEAM SETTLING TIMES AND RELATED METHODS

RELATED APPLICATION

This application is based upon prior filed copending provisional application Serial No. 60/255,007 filed Dec. 12, 2000, the entire subject matter of which is incorporated herein by reference in its entirety.

FIELD OF THE INVENTION

The present invention relates to the field of communications, and, more particularly, to phased array antennas.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission or reception pattern of the communications signals in response to the signal environment to improve performance characteristics.

For example, each antenna element typically has a respective phase shifter, programmable delay element, and/or attenuator associated therewith. The phase shifters/attenuators/delay elements may be controlled by a central controller, for example, to adjust respective phases/attenuations/delays of the antenna elements across the array. Thus, it is possible to perform beam shaping or steering on the transmitted signals to target specific geographical locations, or conversely to focus the antenna such that only signals coming from a certain direction will be received.

One example of a beam steering module for a phased array antenna is disclosed in U.S. Pat. No. 5,027,126 to Basehgi et al. The module includes a plurality of registers each for storing a control word for a respective phase shifter. The control words are provided by a controller. Steering logic within the module sequentially applies each of the control words from the plurality of registers to a control input of a respective phase shifter. Furthermore, the control words are stored in a temporary register bank until all of the control words have been received. The contents of the temporary memory register bank are then transferred to the plurality of registers so that new control words can be received while the steering logic is sequentially applying each control word to its respective phase shifter.

A stated goal of the above patent is to reduce beam settling time. In typical prior art antennas, a host will issue a beam control command (e.g., a beam steering command) prior to the instant when it is to be implemented. The host will subsequently issue a synchronizing pulse that controls precisely when a previously-sent beam steering command is to be implemented. Yet, in many phased array antennas the settling time required to implement the synchronization pulse and allow the beam to settle to the new pointing angle may be in the tens or even hundreds of microseconds. Such relatively lengthy beam settling times may equate to appreciable and undesirable signal outages during this interval. Yet, prior art approaches such as that disclosed in the above patent are generally limited in their ability to precisely manage and distribute synchronization timing and distribution. This may be the result of relatively large uncertainties in the time needed for processing the host synchronization pulse and distributing synchronization control signals, for example.

SUMMARY OF THE INVENTION

In view of the foregoing background, it is therefore an object of the invention to provide a phased array antenna having reduced beam settling times and related methods.

This and other objects, features, and advantages in accordance with the present invention are provided by a phased array antenna which may include a substrate and a plurality of phased array antenna elements carried by the substrate. The phased array antenna may also include a plurality of antenna element controllers for the phased array antenna elements and a central controller for providing beam steering commands and an edge trigger synchronization signal for the antenna element controllers, for example, based upon host beam steering commands and host synchronization signals. Furthermore, each of the antenna element controllers may store a respective next beam steering command and implement the respective next beam steering command as a respective active beam steering command responsive to the edge trigger synchronization signal from the central controller.

More particularly, the phased array antenna may also include a distribution network connecting the central controller to the plurality of antenna element controllers. The central controller and the distribution network may cooperate to deliver the edge trigger synchronization signal substantially simultaneously to all of the antenna element controllers. Further, the central controller may include a multiplexer switchable between a normal state for delivering beam steering commands to the antenna element controllers and a synchronization state for delivering the edge trigger synchronization signal (e.g., from the host) to all of the antenna element controllers. Each antenna element controller may detect the edge trigger synchronization signal from the central controller only during a predetermined time window.

In addition, each antenna element controller may include at least one holding register for storing the next beam steering command. Further, each antenna element controller may include at least one active register for storing the active beam steering command. The phased array antenna may further include at least one array subgroup controller connected between the central controller and a subgroup of the antenna element controllers. Also, the beam steering commands may include at least one of a phase value, attenuation value, and delay value.

A method aspect of the invention is for operating a phased array antenna as described above. The method may include using the central controller to provide edge trigger synchronization signals (e.g., from the host) and, at each of the antenna element controllers, storing a respective next beam steering command and implementing the respective next beam steering command as a respective active beam steering command responsive to the edge trigger synchronization signal from the central controller.

More particularly, using the central controller may include using the central controller to deliver the edge trigger synchronization signal substantially simultaneously to all of the antenna element controllers. Additionally, the central controller may include a multiplexer, and the method may further include switching the multiplexer between a normal state for delivering beam steering commands to the antenna element controllers, and a synchronization state for delivering the edge trigger synchronization signal to all of the antenna element controllers.

Further, each antenna element controller may detect the edge trigger synchronization signal from the central controller only during a predetermined time window. Also, at least one array subgroup controller may be connected between the central controller and a subgroup of the antenna element controllers, and the beam steering commands may include at least one of a phase value, attenuation value, and a delay value.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
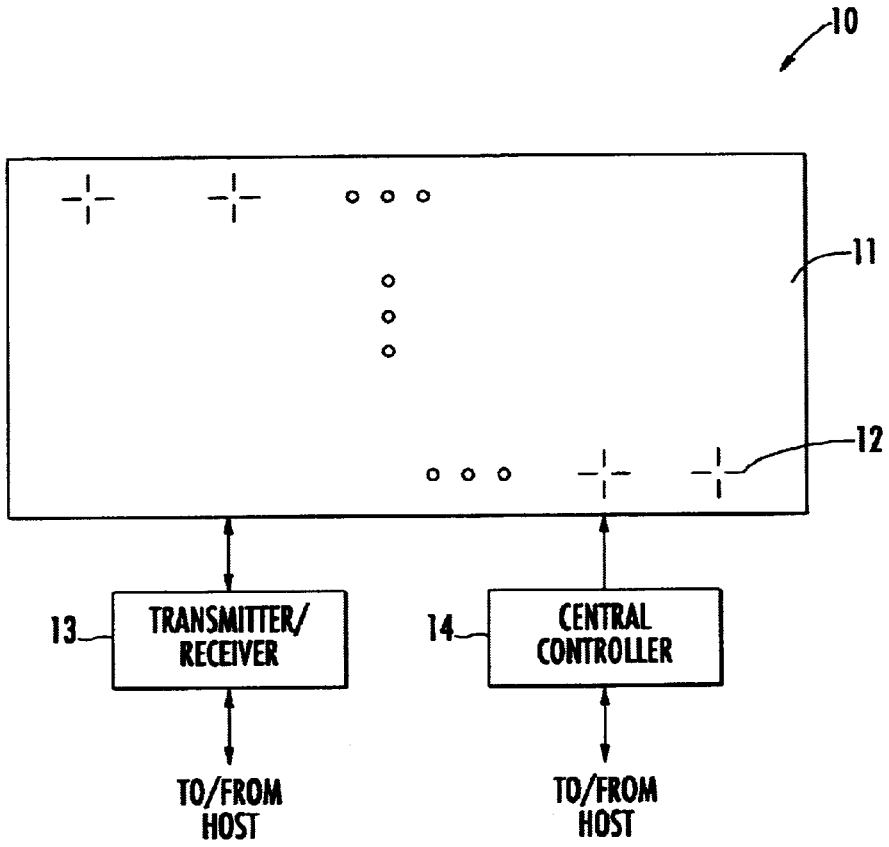
FIG. 1 is schematic block diagram of a phased array antenna according to the present invention.

Referring initially to FIG. 1, a phased array antenna 10 according to the invention includes a substrate 11 and a plurality of phased array antenna elements 12 carried thereby. As used herein, "substrate" refers to any surface, mechanized structure, etc., which is suitable for carrying a phased array antenna element, as will be appreciated by those of skill in the art. The phased array antenna 10 may also include a transmitter and/or receiver 13 for sending and/or receiving communications signals (e.g., microwave or RF signals) via the antenna elements 12, and a central controller 14, which will be described further below. The transmitter/receiver 13 and central controller 14 (such as a microprocessor) may also be connected to a host (not shown), which processes the signals to be transmitted or received and for providing beam steering commands to the central controller, for example. The phased array antenna 10 may be used for ground, airborne, or spaceborne applications, as will be readily understood by those skilled in the art.

Figure 2:
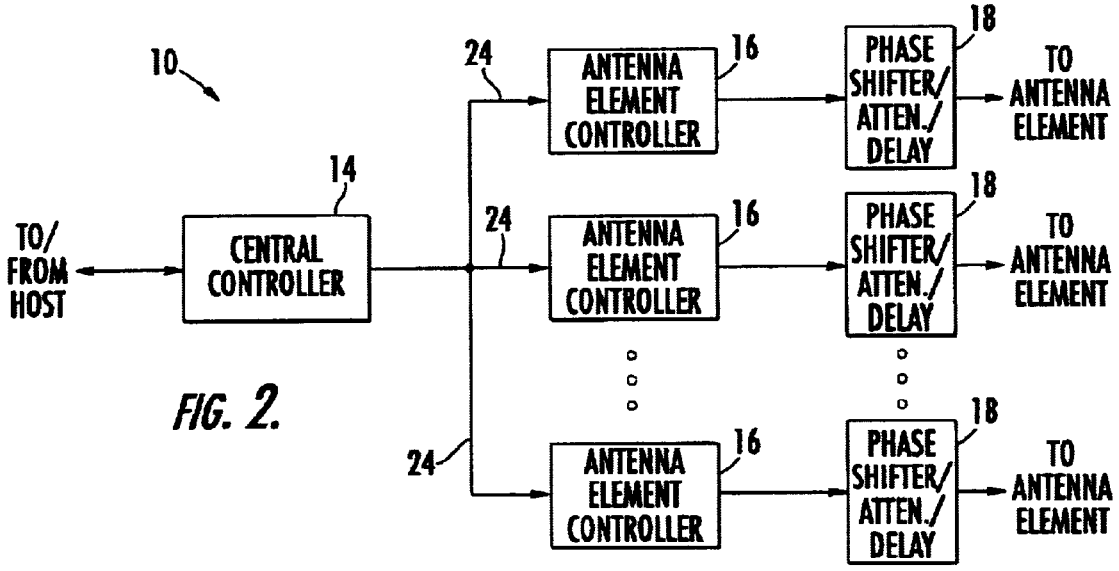
FIG. 2 is a more detailed schematic block diagram of the controller portion of the phased array antenna of FIG. 1.
Figure 3:
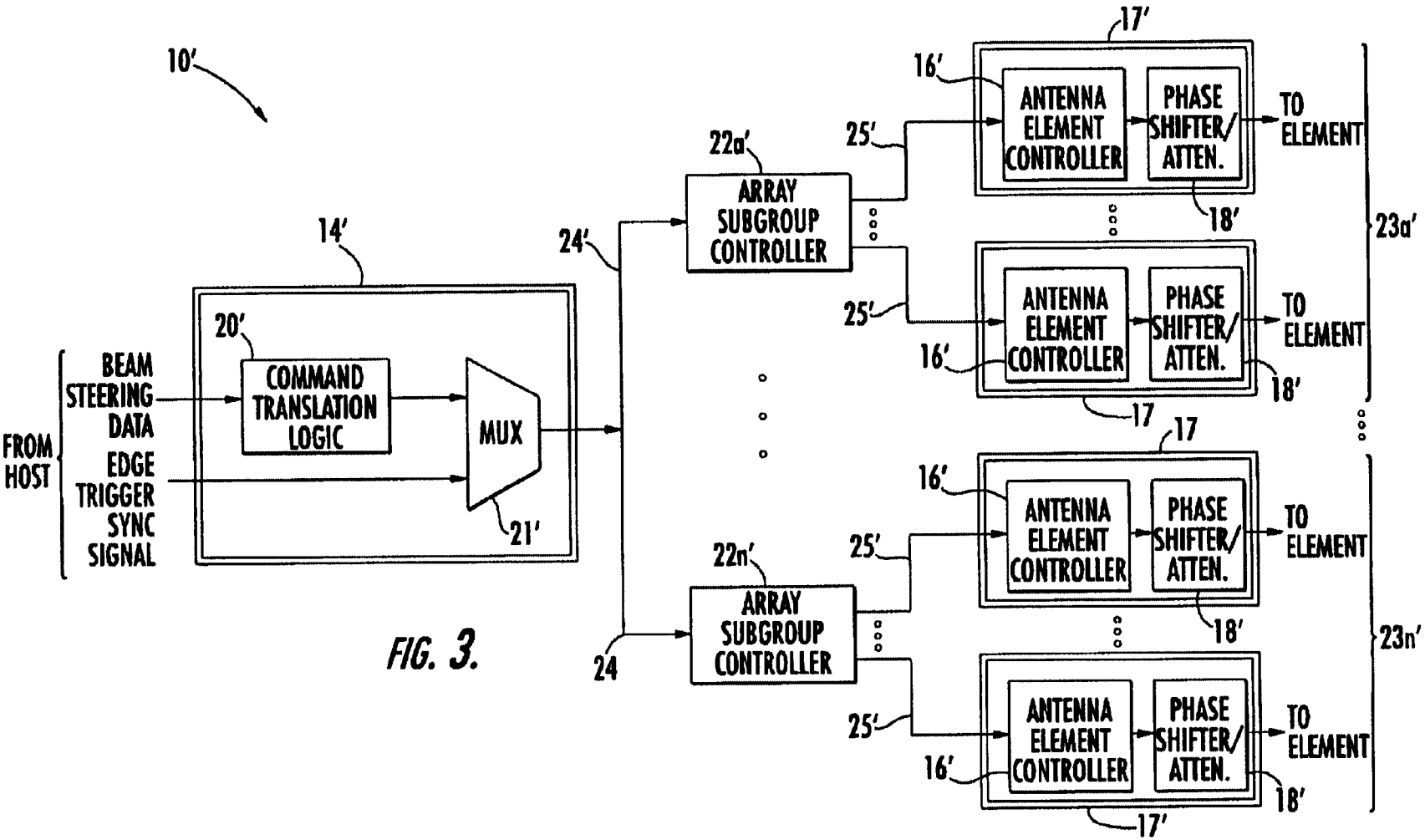
FIG. 3 is a more detailed schematic block diagram of an alternate embodiment of the phased array antenna of FIG. 1

Turning now additionally to FIGS. 2 and 3, the phased array antenna 10 includes a plurality of antenna element controllers 16 for the phased array antenna elements 12. In some embodiments, each antenna element controller 16' may be included within a respective antenna element module 17', as illustratively shown in FIG. 3. Further, there may be one antenna element controller 16 for each of the antenna elements 12, or a single element controller may control more than one antenna element, as will be appreciated by those of skill in the art. Each antenna element controller 16 may further have a phase shifter, delay element, and/or attenuator 18 associated therewith for its respective antenna element 12, as will be appreciated by those of skill in the art. Of course, the phase shifter/attenuator/delay device 18' may be implemented within respective antenna element modules 17', as illustratively shown in FIG. 3.

Based upon host inputs, for example, the central controller 14 provides beam steering commands and a synchronization signal, such as an edge trigger synchronization signal, for the antenna element controllers 16. In some embodiments, particularly those used for radar applications, threshold-type synchronization signals may be used for receive and transmit control, for example, as will be understood by those skilled in the art. More particularly, the central controller 14 may translate signals from the host and provide the beam steering commands and synchronization signal based thereon.

For example, in some embodiments the central controller may directly provide beam steering commands which include respective phase values, attenuation values, and/or delay values, for example, for the phased array antenna elements 12. In other embodiments, the central controller 14 may provide beam steering commands which subgroup controllers 22*a*–22*n* (FIG. 3) (if used) and/or the antenna element controllers 16 translate into the respective phase, attenuation and/or delay values using multiplier/accumulation logic, look-up tables, etc., as will be appreciated by those skilled in the art.

In the embodiment illustrated in FIG. 3, the central controller 14' includes command translation logic 20' for translating the beam steering data from the host to the beam steering commands for the antenna element controllers 12. The command translation logic 20' may be implemented in an application specific integrated circuit (ASIC), for example. Further, the central controller 14' illustratively includes a multiplexer 21' switchable between a normal state and a synchronization state. The normal state is for delivering the beam steering commands output by the command translation logic 20' to the antenna element controllers 16'. The synchronization state is for delivering an edge trigger synchronization signal from the host to the antenna element controllers 12.

More particularly, in the embodiment illustrated in FIG. 3, the phased array antenna 10' illustratively includes one or more array subgroup controllers 22*a*'–22*n*', each of which is connected between the central controller 14' and the antenna element controllers 16' of respective subgroups 23*a*'–23*n*' of the antenna element modules 17'. The array subgroup controllers 22*a*'–22*n*' may also include one or more control ASICs, for example. Also, as illustratively shown in FIG. 2, a distribution network including a plurality of communication links 24 connects the central controller 14 to the antenna element controllers 16.

For the embodiment illustrated in FIG. 3, the distribution network includes communication links 24' which connect the central controller 14' to the array subgroup controllers 22*a*'–22*n*', and communication links 25' which connect the array subgroup controllers to respective antenna element controllers 16'. The communication links 24', 25' may be serial data communication links, for example, and may include wires, fibers, or may even be wireless links in some embodiments. Other suitable communications links known to those of skill in the art may also be used, and parallel links could also be used instead of serial links.

The array subgroup controllers 22*a*'–22*n*' may advantageously be used in some embodiments for simplifying wiring, e.g., by avoiding relatively long communication links to connect the central controller 14' with the antenna element controllers 16'. Further, the array subgroup controllers 22*a*'–22*n*' may perform some of the beam steering command translation and signal distribution functions which would otherwise be required of the central controller 14' and thus allow processing resources thereof to be conserved, as will be understood by those of skill in the art. Of course, any number of array subgroup controllers may be used, and the number selected will vary depending upon factors such as the number of antenna elements 12 used, cost, etc.

Figure 4:
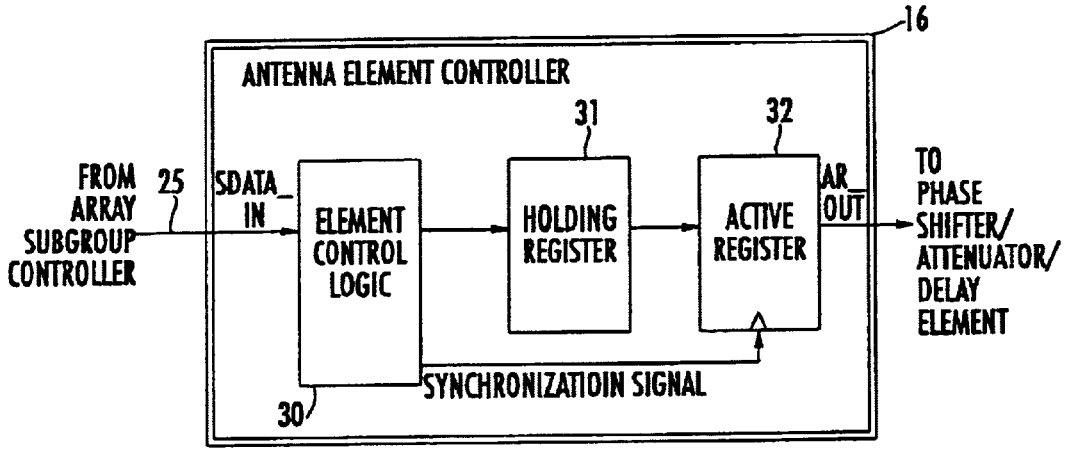
FIG. 4 is a more detailed schematic block diagram of an antenna element controller of FIG. 2.

As illustratively shown in FIG. 4, each antenna element controller 16 may include element control logic 30 for receiving the serial data stream including the beam steering commands and edge trigger synchronization signals from the central controller 14 via the distribution network (and optionally array subgroup controllers 22*a*'–22*n*'). Each antenna element controller 16 also illustratively includes at least one holding register 31 and at least one active register 32. The element control logic 30 edge trigger synchronization signal separates a next beam steering command from the incoming serial data stream. The next beam steering command is then stored in the holding register 31. The antenna element controller 16 implements the next beam steering command as an active beam steering command responsive to the edge trigger synchronization signal from the central controller 14.

Just prior to the next edge trigger synchronization signal, the central controller 14 may send a special command to prepare the element controller 16 for the upcoming synchronization event. The multiplexer 21 in the central controller 14 may then switch to a synchronization broadcast mode until the edge trigger synchronization signal occurs and all antenna element modules 17 change the contents of the active register 32 to be the value held in the holding register 31. Then, the multiplexer 21 may switch back to the normal mode and the element controllers 16 may resume normal operation. The active beam steering command is stored by the active register 32. The antenna element controller 16 may also advantageously be implemented in an ASIC, field-programmable gate array (FPGA) device, or other suitable devices, for example.

In accordance with the present invention, the central controller 14 and distribution network (and array subgroup controllers 22*a*'–22*n*', if used) may cooperate to deliver the edge trigger synchronization signal, substantially simultaneously to all of the antenna element controllers 16. As a result, each of the phase shifters/attenuators/delay elements 18' receive their respective active beam steering commands at substantially the same time. Thus, all of the phase, attenuation and/or delay settings of the antenna elements 12 are changed at substantially the same time. This may advantageously provide reduced beam settling time, as well as a more uniform beam change than in prior art systems where respective phases or attenuations of the antenna elements are not all changed at once.

Moreover, to further decrease beam settling time, the edge trigger synchronization signal may be passed essentially directly through the central controller 14' and array subgroup controllers 22*a*'–22*n*' during the synchronization state without being encoded or otherwise processed. For example, prior art controllers typically encode the synchronization pulse provided by the host and convert it into a command or encoded word. This additional processing step increases synchronization distribution delay, thus increasing synchronization delay uncertainty and leading to increased beam settling time.

Figure 5:
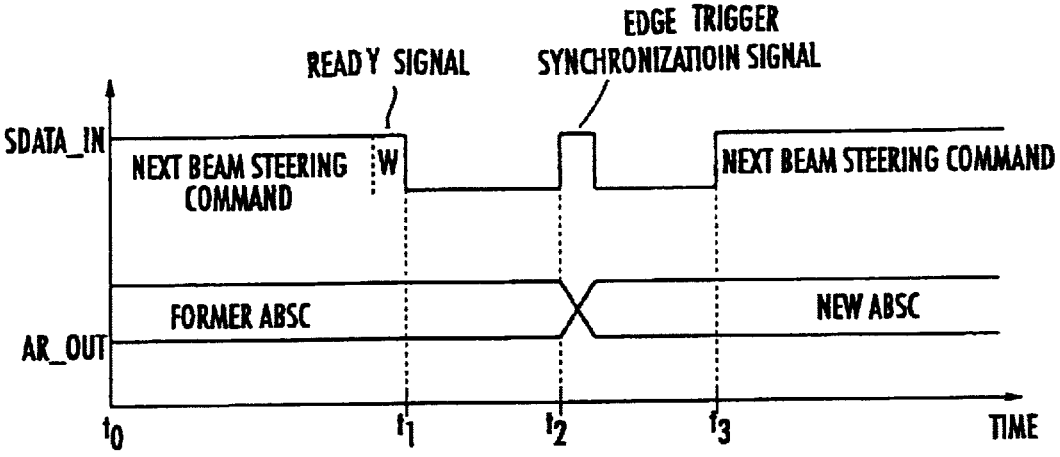
FIG. 5 is a timing diagram illustrating detection of the edge trigger synchronization signal from the central controller during a predetermined time window according to the present invention.

According to the invention, each antenna element controller 16 may advantageously detect the edge trigger synchronization signal from the central controller 14 only during a predetermined time window, for example, as will be understood more clearly with reference to FIG. 5. The illustrated signal SDATA_in represents the serial data stream being input to the element control logic 30. At a time $t_0$, the next beam steering command is being transmitted to the element controller 16. Other data transfers can also occur during this interval, e.g. configuration data, telemetry data, etc.

At the end of the next beam steering command, the central controller 14 may transmit a command W which informs the element antenna controllers 16 that the predetermined time window (i.e., from $t_1$ to $t_3$) is about to occur. Thus, the element control logic 30 will be placed in a ready mode to wait for the edge trigger synchronization signal, which the central controller 14 will send (e.g., retransmit from the host) at some time $t_2$ during the predetermined time window (i.e., from $t_1$to $t_3$). In some embodiments including array subgroup controllers 22*a*'–22*n*', the array subgroup controllers may also re-transmit the edge trigger synchronization signal similar to the central controller 14. Because the data buses 24 and 25 do not carry data during the predetermined time window (i.e., from $t_1$, to $t_3$), the data buses can be used to carry the synchronization signal, and a separate distribution network for synchronization is not required.

More particularly, by using a predetermined time window, the timing of the various antenna element controllers 16 need not be exactly synchronized to ensure that each will detect the edge trigger synchronization signal. That is, the timing differential among the various antenna element controllers 16 will be within a certain range, so if the predetermined time window is set to be slightly larger than this range then the edge trigger synchronization signal will be detected by all of the antenna element controllers. Of course, it will be appreciated that the predetermined time window is preferably set to be as short as possible to prevent wasted bandwidth, i.e., as a result of the distribution network remaining unnecessarily idle.

Once the element control logic 30 receives the edge trigger synchronization signal at time $t_2$, this signal is promptly passed along to the active register 32, prompting the active register to store the next active beam steering command. As illustratively shown, the active beam steering command (abbreviated ABSC) is in turn provided at the output AR_out of the active register 32 directly to the digital control input of the phase shifter/attenuator/delay element 18 with minimal delay, as will be appreciated by those of skill in the art. Again, the beam steering command may include a phase value, attenuation value, and/or delay value which may be provided directly from the central controller 14, or may be translated by a subgroup controller 22' and/or element control logic 30 based upon data from the central controller.

Accordingly, delay uncertainty in the present invention is significantly decreased. That is, the delay path uncertainty of a synchronization pulse is generally what determines the beam settling time in a phased array antenna system. Yet, for the present invention, the total delay is small, i.e., it is simply the sum of the propagation delay of the distribution network, the element control logic delay to transfer data from the holding register 31 to the active register 32, and the intrinsic delay of the phase shifter/attenuator 18. Because the total delay is small, the delay uncertainty (e.g., maximum delay minus minimum delay) is also small. According to the present invention, this delay, and consequently the beam settling time, may advantageously be about 50 nanoseconds or less.

It will be appreciated that the present invention may find wide application in phased array antenna systems where relatively fast and predictable beam settling times are desired. For example, the phased array antenna 10 of the present invention is well suited for spaceborne applications where frequent beam steering or shaping is required. Further, broadband wireless access, such as for providing wireless Internet access, radars, etc., are further examples of the numerous applications where the present invention may provide significant advantages.

A method aspect of the invention is for operating a phased array antenna 10' as described above. The method may include using the central controller 14' to provide (e.g., re-transmit from the host) the edge trigger synchronization signal and, at each of the antenna element controllers 16', storing a respective next beam steering command and implementing the respective next beam steering command as a respective active beam steering command responsive to the edge trigger synchronization signal from the central controller.

More particularly, using the central controller 14' may include using the central controller to deliver the edge trigger synchronization signal substantially simultaneously to all of the antenna element controllers 16'. Additionally, the central controller 14' may include a multiplexer 21', and the method may further include switching the multiplexer between a normal state for delivering beam steering commands to the antenna element controllers 16', and a synchronization state for delivering the edge trigger synchronization signal to all of the antenna element controllers. That is, the multiplexer 21' advantageously allows the same distribution network to distribute both the normal serial command data and the synchronization pulse. As a result, significant savings in weight, wiring, connectors, and cost may be obtained.

Further, each antenna element controller 16' may detect the edge trigger synchronization signal from the central controller 14' only during a predetermined time window. Also, at least one array subgroup controller **22*a*'–22*n*' may be connected between the central controller 14' and a respective subgroup 23*a*'–23*n*' of the antenna element controllers 16'**, and the beam steering commands may include-or be used by the element controllers and/or subgroup controllers to determine-at least one of a phase value, attenuation value, and delay value.

Many modifications and other embodiments of the invention will come to the mind of one skilled in the art having the benefit of the teachings presented in the foregoing descriptions and the associated drawings Therefore, it is understood that the invention is not to be limited to the specific embodiments disclosed, and that modifications and embodiments are intended to be included within the scope of the appended claims.

That which is claimed is:

1. A phased array antenna comprising:

a substrate and a plurality of phased array antenna elements carried by said substrate;

a plurality of antenna element controllers for said phased array antenna elements; and a central controller for communicating with a host and for providing beam steering commands to said antenna element controllers during a normal state, providing a ready signal for placing said antenna element controllers in a synchronization state corresponding to a predetermined time window during which the host will provide an edge trigger synchronization signal, and passing the edge trigger synchronization signal from the host to said antenna element controllers substantially immediately upon receipt thereof and without processing thereof;

each of said antenna element controllers storing a respective next beam steering command and implementing the respective next beam steering command as a respective active beam steering command responsive to the edge trigger synchronization signal from said central controller.

2. The phased array antenna according to claim 1 further comprising a distribution network connecting said central controller to said plurality of antenna element controllers.

3. The phased array antenna according to claim 1 wherein said central controller comprises a multiplexer switchable between the normal state for delivering beam steering commands to said antenna element controllers and the synchronization state for delivering the edge trigger synchronization signal to all of said antenna element controllers.

4. The phased array antenna according to claim 1 wherein each antenna element controller comprises at least one holding register for storing the next beam steering command.

5. The phased array antenna according to claim 1 wherein each antenna element controller comprises at least one active register for storing the active beam steering command.

6. The phased array antenna according to claim 1 further comprising at least one array subgroup controller connected between said central controller and a subgroup of said antenna element controllers.

7. The phased array antenna according to claim 1 wherein the beam steering commands comprise at least one of a phase value, attenuation value, and a delay value.

8. A phased array antenna comprising:

a substrate and a plurality of phased array antenna elements carried by said substrate;

a plurality of antenna element controllers for said phased array antenna elements;

central controller for communicating with a host and for providing beam steering commands to said antenna element controllers during a normal state, providing a ready signal for placing said antenna element controllers in a synchronization state corresponding to a predetermined time window during which the host will provide an edge trigger synchronization signal, and passing the edge trigger synchronization signal from the host to said antenna element controllers substantially immediately upon receipt thereof and without processing thereof; and a distribution network connecting said central controller to said plurality of antenna element controllers;

said central controller comprising a multiplexer switchable between the normal state for delivering beam steering commands to said antenna element controllers and the synchronization state for delivering the edge trigger synchronization signal to all of said antenna element controllers;

each of said antenna element controllers storing a respective next beam steering command and implementing the respective next beam steering command as a respective active beam steering command responsive to the edge trigger synchronization signal from said central controller.

9. The phased array antenna according to claim 8 wherein each antenna element controller comprises at least one holding register for storing the next beam steering command.

10. The phased array antenna according to claim 8 wherein each antenna element controller comprises at least one active register for storing the active beam steering command.

11. The phased array antenna according to claim 8 further comprising at least one array subgroup controller connected between said central controller and a subgroup of said antenna element controllers.

12. The phased array antenna according to claim 8 wherein the beam steering commands comprise at least one of a phase value, attenuation value, and a delay value.

13. A phased array antenna comprising:

a substrate and a plurality of phased array antenna elements carried by said substrate;

a plurality of antenna element controllers for said phased array antenna elements;

a central controller for communicating with a host and for providing beam steering commands to said antenna element controllers during a normal state, the beam steering commands comprising at least one of a phase value, attenuation value, and a delay value;

providing a ready signal for placing said antenna element controllers in a synchronization state corresponding to a predetermined time window during which the host will provide an edge trigger synchronization signal, and passing the edge trigger synchronization signal from the host to said antenna element controllers substantially immediately upon receipt thereof and without processing thereof; and at least one array subgroup controller connected between said central controller and a subgroup of said antenna element controllers;

each of said antenna element controllers storing a respective next beam steering command and implementing the respective next beam steering command as a respective active beam steering command responsive to the synchronization signal from said central controller.

14. The phased array antenna according to claim 13 further comprising a distribution network connecting said central controller to said plurality of element controllers.

15. The phased array antenna according to claim 13 wherein said central controller comprises a multiplexer switchable between a normal state for delivering beam steering commands to said antenna element controllers and a synchronization state for delivering the synchronization signal to all of said antenna element controllers.

16. The phased array antenna according to claim 13 wherein each antenna element controller comprises at least one holding register for storing the next beam steering command.

17. The phased array antenna according to claim 13 wherein each antenna element controller comprises at least one active register for storing the active beam steering command.

18. A method for operating a phased array antenna of a type comprising a substrate and a plurality of phased array antenna elements carried by the substrate, a plurality of antenna element controllers for the phased array antenna elements, and a central controller for communicating with a host and for providing beam steering commands to the antenna element controllers during a normal state, the method comprising:

using the central controller to provide a ready signal for placing the antenna element controllers in a synchronization state corresponding to a predetermined time window during which the host will provide an edge trigger synchronization signal, and to pass the edge trigger synchronization signal from the host to antenna element controllers substantially immediately upon receipt thereof and without processing thereof; and at each of the antenna element controllers storing a respective next beam steering command and implementing the respective next beam steering command as a respective active beam steering command responsive to the edge trigger synchronization signal from the central controller.

19. The method according to claim 18 wherein the central controller comprises a multiplexer, and further comprising:

switching the multiplexer between the normal state for delivering beam steering commands to the antenna element controllers, and the synchronization state for delivering the edge trigger synchronization signal to all of the antenna element controllers.

20. The method according to claim 18 further comprising at least one array subgroup controller connected between the central controller and a subgroup of the antenna element controllers.

21. The method according to claim 18 wherein the beam steering commands comprise at least one of a phase value and an attenuation value.

* * * * *